US005670761A

United States Patent [19]

Ryan et al.

[11] Patent Number: 5,670,761

[45] Date of Patent: Sep. 23, 1997

[54] ELECTRICAL SWITCH

[75] Inventors: Eric Thomas Ryan, Cheltenham; Roger Louis Hambidge, Cleltenham, both of England

[73] Assignee: Delta Schoeller Ltd., United Kingdom

[21] Appl. No.: 385,969

[22] Filed: Feb. 9, 1995

[30] Foreign Application Priority Data

Feb. 3, 1994 [GB] United Kingdom ..... 9403481

[51] Int. Cl.[6] ..... H01H 13/70

[52] U.S. Cl. ..... 200/16 B; 200/5 A; 200/18

[58] Field of Search ..... 200/5 R, 5 A, 200/16 R–16 D, 17 R, 18, 50 C, 52 R, 402, 405, 413, 417, 422, 431, 453, 468, 510, 518, 519, 520, 521–523, 530, 534, 537, 329, 341

[56] References Cited

U.S. PATENT DOCUMENTS

| | | | |
|---|---|---|---|
| 2,162,528 | 6/1939 | Curtiss | 200/16 |
| 2,661,402 | 12/1953 | Balch | 200/18 |
| 3,512,427 | 5/1970 | Metcalf | 74/471 |
| 3,584,229 | 6/1971 | West | 290/38 |
| 3,691,323 | 9/1972 | Anderson et al. | 200/4 |
| 4,459,448 | 7/1984 | McDill | 200/311 |
| 5,031,737 | 7/1991 | Dzioba et al. | 192/4 A |

*Primary Examiner*—Michael L. Gellner
*Assistant Examiner*—Michael A. Friedhofer

[57] ABSTRACT

An electrical switch having a plurality of plungers (6) and (8) telescoped one inside another. Each plunger is depressable from an extended position independently of the other(s) against a bias provided by a spring (28, 46) to operate respective switch contacts (62, 56).

10 Claims, 2 Drawing Sheets

ELECTRICAL SWITCH

BACKGROUND OF THE INVENTION

This invention relates to electrical switches.

The background to the invention will be explained in relation to a particular application. Other applications may readily occur to the reader.

When motor vehicles are fitted with a cruise control which operates to maintain a chosen speed without the need for the driver to operate the accelerator pedal, a switch is used to disable the cruise control when the vehicle's brakes are operated. The vehicle's brake light switch is conventionally opened against a bias by the brake pedal return spring when the brake pedal is released and is closed by the bias when the brake pedal is depressed. A separate switch from that used to operate the brake lights is used because of the risk that an overload of the brake lights circuit might cause the brake lights switch to over heat to the point of softening the plastics material of which its operating mechanism is conventionally made. Following this, release of the brake pedal would operate the softened mechanism to return the switch to its open position. The softened operating mechanism would inevitably distort, then cool and harden when the brake light current was no longer being drawn. The next time the brake was operated would find the switch jammed and unable to close. The cruise control would thus not be disabled.

SUMMARY OF THE INVENTION

Against this background, one aspect of the invention provides an electrical switch, comprising: a plurality of plungers telescoped one inside another and each depressable from an extended position independently of the other(s) against a bias to operate respective switch contacts.

In the exemplary application, the brake lights would be operated by one plunger and the cruise control disabled by operation of an other plunger. If the brake light contacts were overloaded and softened their plunger, even if this remained depressed the next time the brakes were operated, the plunger which operates contacts to disable the cruise control may return to an extended position to disable the cruise control. Provision and fitting of separate switches for the brake lights and the cruise control and of a mechanism allowing them to be operated separately by depression of the brake pedal is thus avoided.

In the exemplary application the switch preferably has two plungers, an inner plunger and an outer plunger.

To facilitate operation in the exemplary application, the switch preferably includes stops to limit the extended positions of the plungers so that their outer ends are flush with one another.

The outer plunger is preferably formed with a cam surface, a respective moving switch contact or switch contacts being provided with a cam follower so that axial movement of the outer plunger causes movement of the follower in a direction normal to the direction of movement of the plunger, so as to open the respective contacts. Preferably, the axial movement of the inner plunger is transmitted to one or more respective moving contacts. In this arrangement the inner plunger preferably operates the brake lights so that any softening of the inner plunger is beyond the outer plunger and thus does not interfere with subsequent operation of the outer plunger.

Recognising the value of the exemplary application, a second aspect of the invention extends to a motor vehicle having a switch of the first aspect fitted so that the two plungers are depressed by release of the vehicle's brake pedal, the switch contacts operated by the inner plunger being arranged to operate brake lights and the switch contacts operated by the outer plunger being arranged to disable a cruise control when the vehicle's brakes are operated.

BRIEF DESCRIPTION OF THE DRAWING

One embodiment of the invention will now be described, by way of example, with reference to the accompanying drawing in which.

DESCRIPTION OF A PREFERRED EMBODIMENT OF THE INVENTION

Figure 1:
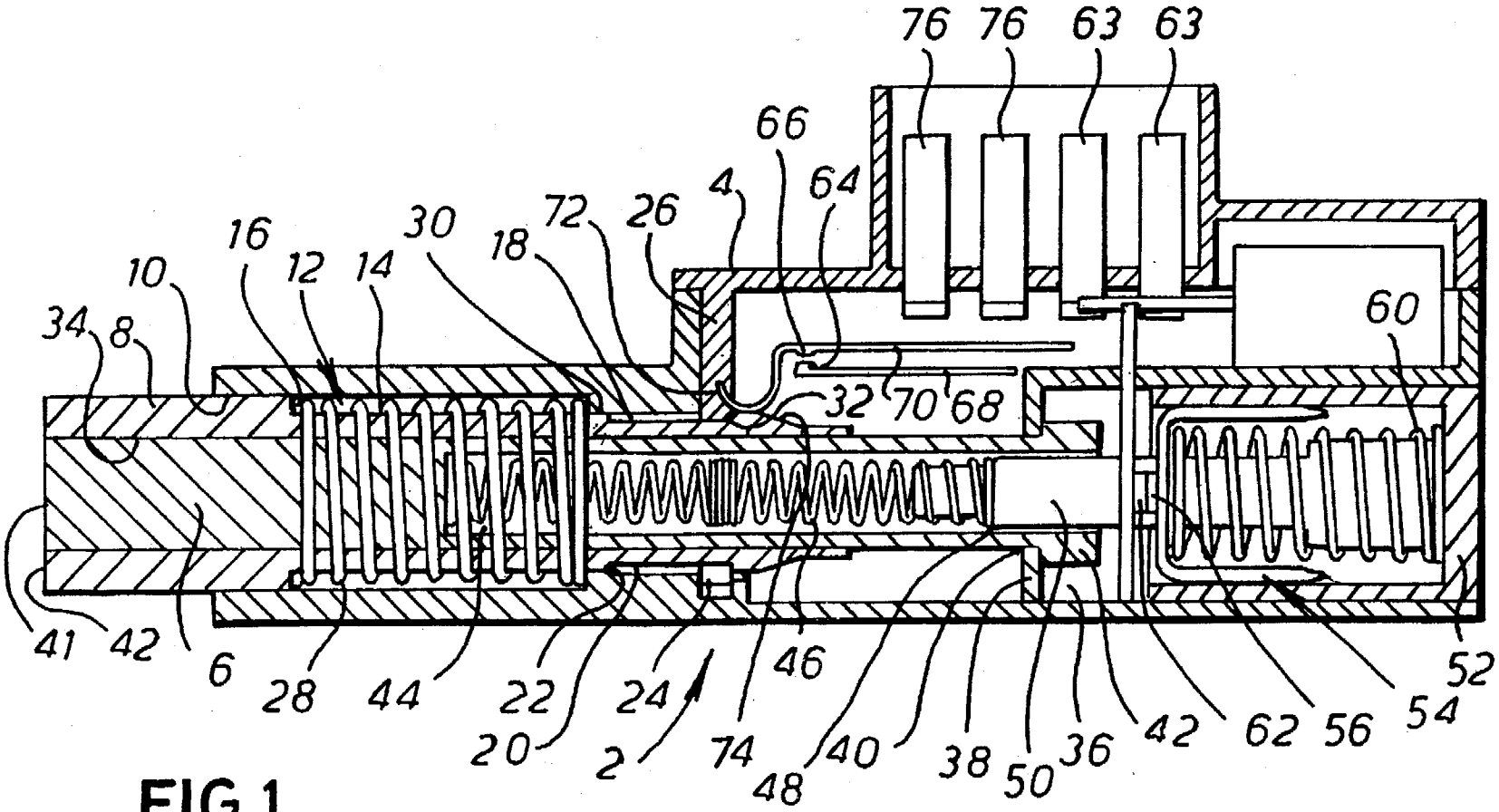
FIG. 1 is a schematic cross section through an electrical switch embodying the invention.

The electrical switch shown in the drawing is intended to operate the brake lights of a motor vehicle and to disable a cruise control when the brake pedal is depressed.

A body 2 has a cover 4 and contains two plungers 6 and 8, the inner plunger 6 being telescoped inside the outer plunger 8. In the embodiment illustrated, the plungers are concentric, i.e. have a common longitudinal axis. The outer plunger 8 has a full diameter portion 10 slidable axially in a full diameter portion 10 of a bore 12 in the body 2. An intermediate portion 14 of the plunger 8 extends from a shoulder 16 with a reduced diameter which is slidable in a reduced diameter portion 18 of the bore 12. A further portion 20 of the plunger 8 extends from a shoulder 22 with a reduced diameter which is slidable in a slot 24 in a stop member 26 moulded on the inside of the cover 4. The plunger is biased outwardly from the bore 10 by spring 28 which acts in compression between the shoulder 16 and a shoulder 30 between the portions 12 and 18 of the bore. Outward movement of the plunger 8 is limited by engagement of a shoulder 32 against one side of the stop member 26. Depression of the plunger 8 is limited by engagement of the shoulder 22 with the other side of the stop member 26.

The inner plunger 6 is slidable in a bore 34 in the outer plunger. The body 2 has a cavity 36 formed by wall 38 opposite the bore 10. The inner plunger 6 is slidable in a hole 41 through the wall 38 and has an enlarged end section which engages the wall 38 to limit outward movement of the inner plunger 6 so that its outer end 40 lies flush with the outer end 42 of the outer plunger. The inner plunger 6 has an internal blind plunger 6. A compression spring 46 acts between the end of the bore 44 and a shoulder 48 on a mandrel 50 on which the bore 44 is slidable.

Figure 2:
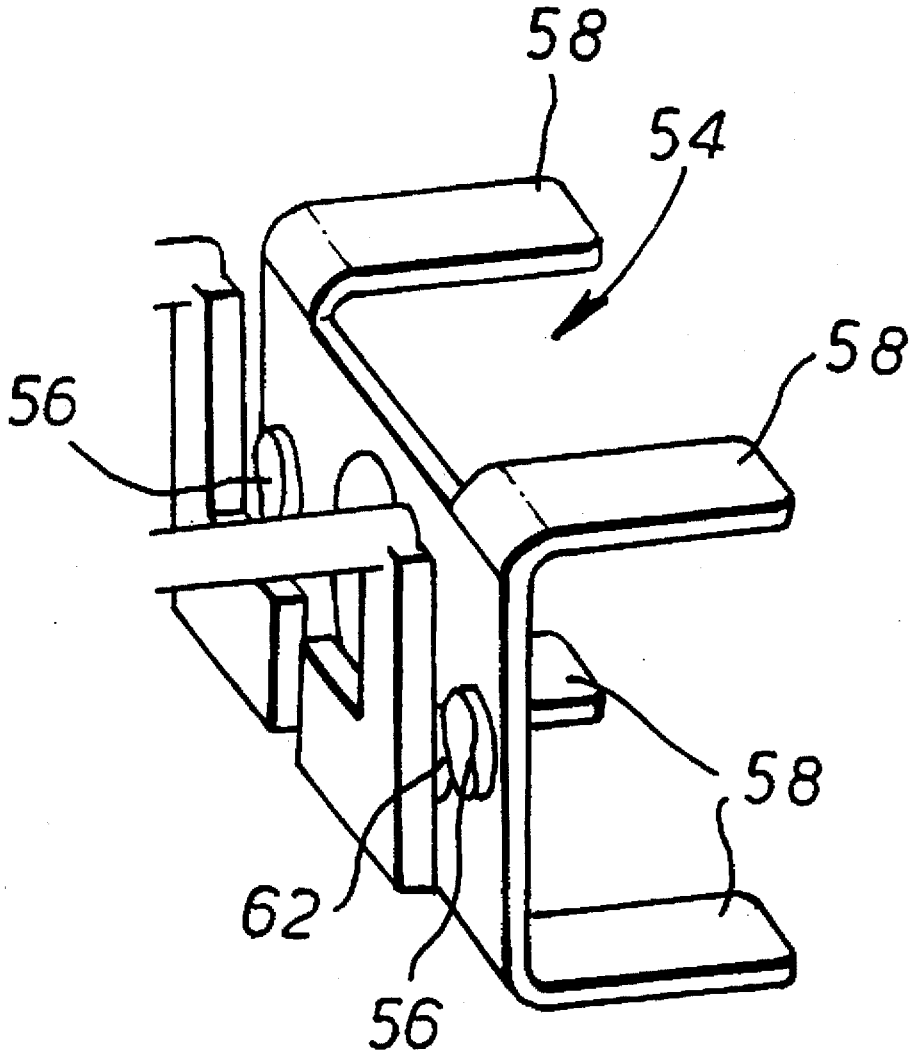
FIG. 2 is a pictorial detail view of an arrangement of contacts in the switch of FIG. 1.

The mandrel 50 is integrally moulded with and projects from a plug in the form of a pot 52 which is fixedly mounted in a position closing the cavity 36. Two moving contacts 56 are mounted on a conductive moving contact carrier 54. Four legs 58 (see FIG. 2) guide the moving contact carrier slidingly in the pot 52. A compression spring 60 encircling the mandrel 50 urges the moving contact carrier towards two fixed contacts 56 to provide electrical continuity between the connectors 63 when the contacts 56 and 62 are closed.

The connectors 63 connect the switch contacts 56 and 62 in the brake light circuit. The switch is installed so that when the brake pedal is operated the plungers 6 and 8 are released and free to extend under the bias of their respective springs 46 and 28. This action causes contact between the contacts 56 and 62 resulting in electrical continuity between the connectors 63 and illuminating the vehicle's brake lights.

When the brake pedal is released, it is returned to an upper position by a return spring. The return spring is strong enough to depress both the plungers 6 and 8 against their bias springs 46 and 28.

Axial movement caused by depressing the inner plunger 6 initially moves the enlarged end of the plunger 6 against the moving contact carrier 54. Further axial movement is transmitted to the contact carrier 54 against the bias of the spring 60 opening the contacts 56 and 62 so turning off the brake lights.

If, when the brake lights are illuminated, the switch is subject to an overload and the relevant fuse does not blow, it is possible that sufficient heating will occur in the region of the contacts 56 and 62 to soften the surrounding plastics parts. Thus the mandrel 50 and pot 52 may soften and distort. When the brake pedal presses on the plunger 6 the softened material will allow it to depress despite the distortion and further distortion may occur. The contacts 56 and 62 will thus be separated but if the carrier 54 is sufficiently hot, there may in addition be softening of the enlarged end 42 of the plunger 6. With the contacts 56 and 62 open, the source of heat is removed and the plastics will cool and harden. One way and another, it is most likely that the next time the brakes are operated the inner plunger 6 will have jammed and will not extend under the bias of its spring 44 so the contacts 56 and 62 will not make.

If the plunger 6 were used also to operate switch contacts to disable the vehicle's cruise control, that disablement would be ineffective.

A further fixed contact 64 and moving contact 66 are mounted on carriers 68 and 70 at least that carrier 70 bearing the moving contact 66 being made of resiliently flexible material, e.g. phosphor bronze. The carriers are connected via connectors 76 in a cruise control circuit. The moving contact carrier 70 is formed at its free end with a crook 72 which engages the outer plunger 8. Axial movement of the outer plunger 8 causes the a camming surface 74 to move the crook in a transverse direction thus opening or closing the contacts 64 and 66 enabling the cruise control when the outer plunger 8 is depressed and disabling the cruise control when the plunger is extended.

Although the inner plunger may have been distorted, the area likely to be heated sufficiently to soften is well spaced from the end of the outer plunger so that it is not likely that the outer plunger will jam on the inner plunger. Operation of the outer plunger will therefore reliably enable and disable the cruise control even though the inner plunger is stuck following a brake circuit overload.

We claim:

1. An electrical switch comprising a housing containing first and second sets of switch contacts, first and second plungers movable within said housing for operating said first and second contact sets, respectively, first and second biasing means connected between said housing and respective plungers for independently urging said plungers outwardly of said housing and to respective extended positions relative to said housing, said first plunger being telescoped within said second plunger, and each of said plungers being movable independently of the other of said plungers from said respective extended position for operating said corresponding contact set.

2. A switch according to claim 1 wherein each of said plungers has an end disposed outwardly of said housing, and including stop means on said housing for engaging and limiting the extended positions of said plungers so that said ends are flush with one another.

3. A switch according to claim 1 wherein said second plunger is formed with a cam surface, and said second contact set is provided with a cam follower so that movement of said second plunger causes movement of the follower in a direction transverse to a direction of movement of said second plunger for operating said second contact set.

4. A switch according to claim 1 wherein said first contact set comprises first and second contacts, said first contact being fixedly mounted within said housing, said second contact being mounted for movement within said housing into and out of engagement with said first contact, and said first plunger moving said second contact relative to said first contact.

5. A switch according to claim 1 in combination with a motor vehicle including a brake, a brake pedal, brake lights, and a vehicle cruise control, said switch being mounted on said vehicle adjacent to said brake pedal so that both of said plungers are moved inwardly of said housing by release of said pedal, and, upon operation of said brake pedal, said first switch contact set operated by said first plunger functions to operate said brake light and said second switch contact set operated by said second plunger functions to disable said cruise control.

6. A switch according to claim 5 wherein said first switch contact set is subject to, under defective brake light conditions, overheating causing deformation of a portion of the housing immediately adjacent to said first contact set and an attendant locking of said first plunger within said deformed portion, said housing having first and second ends and said plungers entering said housing from said first end and extending towards said second end, said first contact set being disposed adjacent to said second end of said housing, said second contact set being spaced from said first contact set and being disposed intermediate said housing ends, and said second plunger being sufficiently shorter than said first plunger such that an inner end of said second plunger never approaches sufficiently close to said first contact set as to be affected by any said deformation of said housing portion for allowing unimpeded movements of said second plunger even upon said locking of said first plunger.

7. An electrical switch comprising a housing having a passageway therethrough extending from a first end of said housing towards a second end thereof, a first switch contact set disposed within said passageway adjacent to said housing second end and a second switch contact set disposed within said passageway intermediate said housing ends, first and second plungers disposed within said passageway for axial movement therein over respective preselected ranges of movement, said first plunger being slidably disposed within said second plunger, both said plungers having respective inner ends disposed within said passageway and respective outer ends extending outwardly from said passageway and away from said housing first end, spring bias means associated with each of said plungers for biasing each of said plungers independently of one another against movement inwardly of said housing, said second plunger operating said second contact set upon relative movements between said second plunger and said second contact set, said first plunger extending forwardly from said second plunger within said housing for reaching to and operating said first contact set upon movement of said first plunger inwardly of said housing, and said second plunger being of such short axial length as to be always spaced at least a preselected distance from said first contact set over the full range of movements of said second plunger.

8. A switch according to claim 7 wherein said second contact set comprises first and second contacts, said first contact being fixedly mounted within said housing and said second contact being mounted on a carrier movable within said housing and spring biased in a direction for causing engagement of said first and second contacts, and said inner end of said second plunger engaging said carrier upon inward movement of said second plunger for moving said carrier in a direction for disengaging said first and second contacts.

9. A switch according to claim 7 wherein said housing is made of a plastic material subject to melting upon overheating, and said preselected distance is selected for preventing entry of said second plunger into a region of said housing subject to, being deformed owing to defective conditions leading to said overheating of said first contact set.

10. A switch according to claim 7 wherein said second plunger contains a blind bore extending backwardly from the inner end of said second plunger and forming a surface within said second plunger, said second plunger inner end being slidably mounted on a mandrel fixedly mounted within said housing, said mandrel extending inwardly of said blind bore and terminating short of said surface therewithin, and a spring disposed within said blind bore between said mandrel and said surface and providing said spring bias for said second plunger.

* * * * *